US007065950B2

(12) United States Patent
Zhu et al.

(10) Patent No.: US 7,065,950 B2
(45) **Date of Patent: *Jun. 27, 2006**

(54) MODACRYLIC/ARAMID FIBER BLENDS FOR ARC AND FLAME PROTECTION

(75) Inventors: Reiyao Zhu, Midlothian, VA (US); Debbie Guckert, Chester, VA (US); Susan L. Lovasic, Chester, VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 97 days.

This patent is subject to a terminal disclaimer.

(21) Appl. No.: 10/803,383

(22) Filed: Mar. 18, 2004

(65) Prior Publication Data

US 2005/0204718 A1 Sep. 22, 2005

(51) Int. Cl.
*D02G 3/02* (2006.01)

(52) U.S. Cl. ..... 57/255

(58) Field of Classification Search ..... 428/357, 428/359, 364, 392, 395; 57/252–257
See application file for complete search history.

(56) References Cited

U.S. PATENT DOCUMENTS

| | | | | |
|---|---|---|---|---|
| 3,094,511 | A | 6/1963 | Hill, Jr. et al. | |
| 3,193,602 | A | 7/1965 | Leonard et al. | |
| 3,354,127 | A | 11/1967 | Hill, Jr. et al. | |
| 3,673,143 | A | 6/1972 | Bair et al. | |
| 3,748,302 | A | 7/1973 | Jones | |
| 3,819,587 | A | 6/1974 | Kwoleck | |
| 3,869,429 | A | 3/1975 | Blades | |
| 4,172,938 | A | 10/1979 | Mera et al. | |
| 4,918,912 | A * | 4/1990 | Warner | 57/255 |
| 4,920,000 | A | 4/1990 | Green | |
| 4,970,111 | A | 11/1990 | Smith, Jr. | |
| 5,208,105 | A | 5/1993 | Ichibori et al. | |
| 5,223,334 | A | 6/1993 | Green | |
| 5,348,796 | A | 9/1994 | Ichibori et al. | |
| 5,503,916 | A | 4/1996 | Ichibori et al. | |
| 5,506,042 | A | 4/1996 | Ichibori et al. | |
| 6,132,476 | A | 10/2000 | Lunsford et al. | |
| 6,254,988 | B1 | 7/2001 | Zhu et al. | |
| 6,547,835 | B1 | 4/2003 | Lunsford et al. | |
| 6,787,228 | B1 | 9/2004 | Campbell et al. | |
| 6,800,367 | B1 * | 10/2004 | Hanyon et al. | 428/364 |
| 2001/0009832 | A1 | 7/2001 | Shaffer et al. | |
| 2003/0203688 | A1 | 10/2003 | Campbell et al. | |
| 2005/0025963 | A1 * | 2/2005 | Zhu | 428/364 |

FOREIGN PATENT DOCUMENTS

| | | |
|---|---|---|
| EP | 0 940 487 A | 9/1999 |
| GB | 2 152 542 A | 8/1985 |

OTHER PUBLICATIONS

W. Black et al., Man-Made Fibers, Science and Technology, vol. 2, "Fiber Forming Aromatic Polyamides", p. 297, Interscience Publishers, 1968.

* cited by examiner

*Primary Examiner*—Shaun R Hurley

(57) ABSTRACT

A yarn, fabric and garment suitable for use in arc and flame protection contains modacrylic, p-aramid and m-aramid fibers.

22 Claims, No Drawings

MODACRYLIC/ARAMID FIBER BLENDS FOR ARC AND FLAME PROTECTION

BACKGROUND OF THE INVENTION

1. Field of the Invention

This invention relates to a blended yarn useful for the production of fabrics which possess arc and flame protective properties. This invention also relates to garments produced with such fabrics.

2. Description of Related Art

Individuals working near energized electrical equipment and emergency personnel who respond to incidents near electrical equipment are at risk from electrical arcs and flame hazards which could result from an arcing event. Electrical arcs are extremely violent events typically involving thousands of volts and thousands of amperes of electricity. Electrical arcs are formed in air when the potential difference (i.e. voltage) between two electrodes causes the atoms in the air to ionize and become able to conduct electricity.

U.S. Pat. No. 5,208,105 to Ichibori et. al. discloses a flame retarded composite fiber blend comprising a halogen containing fiber having a large amount of an antimony compound and at least one fiber selected from the list consisting of natural fibers and chemical fibers. The fiber blend is woven into a fabric and tested for Limited Oxygen Index as a measure of its flame resistance.

What is needed is a yarn, fabric and garment which possess a high level of arc and flame protection.

SUMMARY OF THE INVENTION

This invention relates to yarn for use in arc and flame protection fabrics and garments comprising:

(a) 40 to 70 weight percent modacrylic fiber, (b) 5 to 20 weight percent p-aramid fiber and 10 to 40 weight percent m-aramid fiber, said percentages on the basis of components (a) (b) and (c).

Furthermore the fabric and garment can provide resistance to break open and abrasion.

DETAILED DESCRIPTION OF THE INVENTION

This invention relates to providing a yarn from with fabrics and garment may be produced that provide both arc protection and flame resistance. Fabrics and garments comprising flame resistant fibers of low tensile strength when exposed to the intense thermal stress of an electrical arc can break open exposing the wearer to additional injury as a result of the incident energy. Electrical arcs typically involve thousands of volts and thousands of amperes of electrical current. The electrical arc is much more intense than incident energy such as from flash fire. To offer protection to a wearer a garment or fabric must resist the transfer to energy through to the wearer. It is believed that this occurs both by the fabric absorbing a portion of the incident energy and by the fabric resisting breakopen. During breakopen a hole forms in the fabric directly exposing the surface or wearer to the incident energy.

Yarns, fabrics and garments of this invention when exposed to the intense thermal stress of an electrical arc resist the transfer of energy. It is believed that this invention reduces energy transfer by absorbing a portion of the incident energy and through charring allows a reduction in transmitted energy.

Yarns of this invention comprise a blend of modacrylic fiber, meta-aramid fiber, and para-aramid fiber. Typically, yarns of this invention comprise 40 to 70 weight percent modacrylic fiber, 5 to 20 weight percent para-aramid fiber, and 10 to 40 percent meta-aramid fiber. Preferably, yarns of this invention comprise 55 to 65 weight percent modacrylic fiber, 5 to 15 weight percent para-aramid fiber, and 20 to 30 percent meta-aramid fiber. The above percentages are on a basis of the three named components. Additionally an additional abrasion resistant fiber may be added to the yarn to improve durability via improved abrasion resistance.

By "yarn" is meant an assemblage of fibers spun or twisted together to form a continuous strand, which can be used in weaving, knitting, braiding, or plaiting, or otherwise made into a textile material or fabric.

By modacrylic fiber it is meant acrylic synthetic fiber made from a polymer comprising primarily acrylonitrile. Preferably the polymer is a copolymer comprising 30 to 70 weight percent of a acrylonitrile and 70 to 30 weight percent of a halogen-containing vinyl monomer. The halogen-containing vinyl monomer is at least one monomer selected, for example, from vinyl chloride, vinylidene chloride, vinyl bromide, vinylidene bromide, etc. Examples of copolymerizable vinyl monomers are acrylic acid, methacrylic acid, salts or esters of such acids, acrylamide, methylacrylamide, vinyl acetate, etc.

The preferred modacrylic fibers of this invention are copolymers of acrylonitrile combined with vinylidene chloride, the copolymer having in addition an antimony oxide or antimony oxides for improved fire retardancy. Such useful modacrylic fibers include, but are not limited to, fibers disclosed in U.S. Pat. No. 3,193,602 having 2 weight percent antimony trioxide, fibers disclosed in U.S. Pat. No. 3,748,302 made with various antimony oxides that are present in an amount of at least 2 weight percent and preferably not greater than 8 weight percent, and fibers disclosed in U.S. Pat. Nos. 5,208,105 & 5,506,042 having 8 to 40 weight percent of an antimony compound.

Within the yarns of this invention modacrylic fiber provides a flame resistant char forming fiber with an LOI typically at least 28 depending on the level of doping with antimony derivatives. Modacrylic fiber is also resistant to the spread of damage to the fiber due to exposure to flame. Modacrylic fiber while highly flame resistant does not by itself provide adequate tensile strength to a yarn or fabric made from the yarn to offer the desired level of breakopen resistance when exposed to an electrical arc.

As used herein, "aramid" is meant a polyamide wherein at least 85% of the amide (—CONH—) linkages are attached directly to two aromatic rings. Additives can be used with the aramid and, in fact, it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride of the aramid. Suitable aramid fibers are described in Man-Made Fibers—Science and Technology, Volume 2, Section titled Fiber-Forming Aromatic Polyamides, page 297, W. Black et al., Interscience Publishers, 1968. Aramid fibers are, also, disclosed in U.S. Pat. Nos. 4,172,938; 3,869,429; 3,819,587; 3,673,143; 3,354,127; and 3,094,511. M-aramid are those aramids where the amide linkages are in the meta-position relative to each other, and p-aramids are those aramids where the amide linkages are in the para-position relative to each other. In the practice of this invention the aramids most often used are poly(paraphenylene terephthalamide) and poly(metaphenylene isophthalamide).

Within yarns of this invention m-aramid fiber may provide a flame resistant char forming fiber with an LOI of about 26. M-aramid fiber is also resistant to the spread of damage to the fiber due to exposure to flame. M-aramid fiber also adds comfort to fabrics formed of fibers comprising yarn of this invention.

M-aramid fiber provides additional tensile strength to the yarn and fabrics formed from the yarn. Modacrylic and m-aramid fiber combinations are highly flame resistant but do not provide adequate tensile strength to a yarn or fabric made from the yarn to offer the desired level of breakopen resistance when exposed to an electrical arc.

Within yarns of this invention p-aramid fibers provide a high tensile strength fiber which when added in adequate amounts improves the breakopen resistance of fabrics formed from the yarn. Large amounts of p-aramid fibers in the yarns make garments comprising the yarns uncomfortable to the wearer.

The term tensile strength refers to the maximum amount of stress that can be applied to a material before rupture or failure. The tear strength is the amount of force required to tear a fabric. In general the tensile strength of a fabric relates to how easily the fabric will tear or rip. The tensile strength may also relate to the ability of the fabric to avoid becoming permanently stretched or deformed. The tensile and tear strengths of a fabric should be high enough so as to prevent ripping, tearing, or permanent deformation of the garment in a manner that would significantly compromise the intended level of protection of the garment.

Additionally an abrasion resistant fiber may be added to the yarn to improve durability via improved abrasion resistance. By abrasion resistant it is meant the ability of a fiber or fabric to withstand surface wear and rubbing. Preferably the abrasion resistant fiber is a nylon. By nylon it is meant fibers made from aliphatic polyamide polymers; and polyhexamethylene adipamide (nylon 66) is the preferred nylon polymer. Other nylons such as polycaprolactam (nylon 6), polybutyrolactam (nylon 4), poly(9-aminononanoic acid) (nylon 9), polyenantholactam (nylon 7), polycapryllactam (nylon 8), polyhexamethylene sebacamide (nylon 6, 10), and the like are suitable.

The abrasion resistant fiber typically comprises 2 to 15 weight percent of the yarn. Yarns containing less than 2 weight percent of abrasion resistant fiber do not show a marked improvement in abrasion resistance. Yarns containing abrasion resistant fibers in excess of 15 weight percent may experience a reduction in the flame resistance and arc protective properties of the yarn and fabrics formed from the yarn.

Additionally, to the yarn, fabric, or garment of this invention may be added an antistatic component. Illustrative examples are steel fiber, carbon fiber, or a carbon coating to an existing fiber. The conductivity of carbon or a metal such as steel when incorporated in a yarn, fabric, or garment of this invention provides an electrical conduit to assist in dissipating the buildup of static electricity. Static electrical discharges can be hazardous for workers working with sensitive electrical equipment or near flammable vapors. The antistatic component may be present in an amount of 1 to 5 weight percent of the total yarn.

Yarns of this invention may be produced by any of the yarn spinning techniques commonly known in the art such as but not limited to ring spinning, core spinning, and air jet spinning or higher air spinning techniques such as Murata air jet spinning where air is used to twist staple fibers into a yarn. Typically the single yarns produced by any of the common techniques are then plied together to form a ply-twisted yarn comprising at least two single yarns prior to being converted into a fabric.

To provide protection from the intense thermal stresses caused by electrical arcs it is desirable that an arc protective fabric and garments formed from that fabric possess features such as an LOI above the concentration of oxygen in air for flame resistance, a short char length indicative of slow propagation of damage to the fabric, and good breakopen resistance to prevent incident energy from directly impinging on the surfaces below the protective layer.

Thermally protective garments such as firefighter turnout gear typically provide protection against the convective heat generated by an open flame. Such protective garments when exposed to the intense energy generated by an electrical arc can breakopen (i.e. an opening form in the fabric) resulting in the energy penetrating the garment and causing severe injury to the wearer. Fabrics of this invention preferably provide both protection against the convective heat of an open flame and offer increased resistance to breakopen and energy transfer when exposed to an electrical arc.

The term fabric, as used in the specification and appended claims, refers to a desired protective layer that has been woven, knitted, or otherwise assembled using one or more different types of the yarn of this invention. Preferably fabrics of this invention are woven fabrics. Most preferably the fabrics of this invention are a twill weave.

Basis weight is a measure of the weight of a fabric per unit area. Typical units include ounces per square yard and grams per square centimeter. The basis weights reported in this specification are reported in ounces per square yard (OPSY). As the amount of fabric per unit area increases the amount of material between a potential hazard and the subject to be protected increases. An increase in the basis weight of a material suggests that a corresponding increase in protective performance will be observed. An increase in basis weight of fabrics of this invention results in increased breakopen resistance, increased thermal protection factor, and increased arc protection. Basis weights of fabrics of this invention are typically greater than about 8.0 opsy, preferably greater than about 8.7 opsy, and most preferably greater than about 9.5 opsy. It is believed fabrics of this invention with basis weights greater than about 12 opsy would show increased stiffness and would thereby reduce the comfort of a garment produced from such fabric.

Char length is a measure of the flame resistance of a textile. A char is defined as a carbonaceous residue formed as the result of pyrolysis or incomplete combustion. The char length of a fabric under the conditions of test of ASTM 6413-99 as reported in this specification is defined as the distance from the fabric edge, which is directly exposed to the flame to the furthest point of visible fabric damage after a specified tearing force has been applied. Preferably fabric of this invention have a char length of less than 6 inches.

Fabrics of this invention may be used as a single layer or as part of a multi-layer protective garment. Within this specification the protective value of a fabric is reported for a single layer of that fabric. This invention also includes a garment made from the fabrics of this invention.

The yarns of this invention may be present in either the warp or fill of the fabric. Preferably the yarns of this invention are present in both the warp and fill of the resulting fabric. Most preferably the yarns of this invention are exclusively present in both the warp and fill of the fabric.

TEST METHODS

Abrasion Test

The abrasion performance of fabrics of this invention is determined in accordance with ASTM D-3884-01 "Standard Guide for Abrasion Resistance of Textile Fabrics (Rotary Platform, Double Head Method)".

Arc Resistance Test

The arc resistance of fabrics of this invention is determined in accordance with ASTM F-1959-99 "Standard Test Method for Determining the Arc Thermal Performance Value of Materials for Clothing". Preferably fabrics of this invention have an arc resistance of at least 0.8 calories and more preferably at least 1.2 calories per square centimeter per opsy.

Grab Test

The grab resistance of fabrics of this invention is determined in accordance with ASTM D-5034-95 "Standard Test Method for Breaking Strength and Elongation of Fabrics (Grab Test)".

Limited Oxygen Index Test

The limited oxygen index (LOI) of fabrics of this invention is determined in accordance with ASTM G-125-00 "Standard Test Method for Measuring Liquid and Solid Material Fire Limits in Gaseous Oxidants".

Tear Test

The tear resistance of fabrics of this invention is determined in accordance with ASTM D-5587-03 "Standard Test Method for Tearing of Fabrics by Trapezoid Procedure".

Thermal Protection Performance Test

The thermal protection performance of fabrics of this invention is determined in accordance with NFPA 2112 "Standard on Flame Resistant Garments for Protection of Industrial Personnel Against Flash Fire".

Vertical Flame Test

The char length of fabrics of this invention is determined in accordance with ASTM D-6413-99 "Standard Test Method for Flame Resistance of Textiles (Vertical Method)".

The term thermal protective performance (or TPP) relates to a fabric's ability to provide continuous and reliable protection to a wearer's skin beneath a fabric when the fabric is exposed to a direct flame or radiant heat.

LOI

From ASTM G125/D2863

The minimum concentration of oxygen, expressed as a volume percent, in a mixture of oxygen and nitrogen that will just support flaming combustion of a material initially at room temperature under the conditions of ASTM D2863.

To illustrate the present invention, the following examples are provided. All parts and percentages are by weight and degrees in Celsius unless otherwise indicated.

EXAMPLES

Modacrylic/Aramid/Nylon Fabric

Example 1

A thermal protective and durable fabric was prepared having in the both warp and fill of ring spun yarns of intimate blends of Nomex® type 450, Kevlar® 29, Modacrylic and nylon. Nomex® type 450 is poly(m-phenylene isophthalamide)(MPD-I), Modacrylic is ACN/polyvinylidene chloride co-polymer with 6.8% antimony (known as Protex®C), Kevlar® 29 is poly(p-phenylene terephthalamide)(PPD-T) and the nylon used was polyhexamethylene adipamide.

A picker blend sliver of 30 wt. % of Nomex® type 450, 5 wt. % of Kevlar® 29, 50 wt. % of Modacrylic and 15 wt. % of nylon was prepared and processed by the conventional cotton system into a spun yarn having twist multiplier of 3.7 using a ring spinning frame. The yarn so made was 24.6 tex (24 cotton count) single yarn. Two single yarns are then plied on the plying machine to make a two-ply yarn. Using similar process and same twist and blend ratio, a 28.1 tex(21 cotton count) yarn was made for using as fill yarn. The yarns were then two-plied to form a ply yarn.

The Nomex®/Kevlar®/Modacrylic/nylon yarns were used as the warp and fill in a shuttle loom in a 3×1 twill construction. The greige twill fabric had a construction of 26 ends×17 picks per cm (66 ends×42 picks per inch), and basis weight of 240.7 g/m^2 (7.1 oz/yd^2). The greige twill fabric prepared as described above was scoured in hot water and dried under low tension. The scoured fabric is then jet dyed using basic dye. The finished fabric 311.9 g/m^2 (9.2 oz/yd^2) is then tested by its thermal and mechanical properties.

Example 2

A thermal protective and durable fabric was prepared having in the both warp and fill of ring spun yarns of intimate blends of Nomex® type 450, Kevlar® 29, Modacrylic and nylon. Nomex® type 450 is poly(m-phenylene isophthalamide)(MPD-I), Modacrylic is ACN/polyvinylidene chloride co-polymer with 6.8% antimony (known as Protex®C), Kevlar® 29 is poly(p-phenylene terephthalamide)(PPD-T) and the nylon used was polyhexamethylene adipamide.

A picker blend sliver of 25 wt. % of Nomex® type 450, 5 wt. % of Kevlar® 29, 60 wt. % of Modacrylic and 10 wt. % of nylon was prepared and processed by the conventional cotton system into a spun yarn having twist multiplier of 3.7 using a ring spinning frame. The yarn so made was 21.1 tex (28 cotton count) single yarn. Two single yarns are then plied on the plying machine to make a two-ply yarn. Using similar process and same twist and blend ratio, a 22.7 tex(26 cotton count) yarn was made for using as fill yarn. The yarns were then two-plied to form a ply yarn.

The Nomex®/Kevlar®/Modacrylic/nylon yarns were used as the warp and fill in a shuttle loom in a 3×1 twill construction. The greige twill fabric had a construction of 27 ends×21 picks per cm (68 ends×52 picks per inch), and basis weight of 223.7 g/m^2 (6.9 oz/y^2). The greige twill fabric prepared as described above was scoured in hot water and dried under low tension. The scoured fabric is then jet dyed using basic dye. The finished fabric 294.9 g/m^2 (8.7 oz/yd^2) is then tested by its thermal and mechanical properties.

Example 3

A thermal protective and durable fabric was prepared having in the both warp and fill of ring spun yarns of intimate blends of Nomex® type N303, Kevlar® 29, Modacrylic and nylon. Nomex® type N303 is 92% of poly(m-phenylene isophthalamide)(MPD-I), 5% Kevlar® 29 and 3% P140 (nylon coated with carbon for antistatic), Modacrylic is ACN/polyvinylidene chloride co-polymer with 2% antimony, Kevlar® 29 is poly(p-phenylene terephthalamide)(PPD-T) and the nylon used was polyhexamethylene adipamide.

A picker blend sliver of 20 wt. % of Nomex® type 450, 10 wt. % of Kevlar® 29, 60 wt. % of Modacrylic and 10 wt. % of nylon was prepared and processed by the conventional cotton system into a spun yarn having twist multiplier of 3.7 using airjet spinning frame. The yarn so made was 24.6 tex (24 cotton count) single yarn. Two single yarns are then plied on the plying machine to make a two-ply yarn. Using similar process and same twist and blend ratio, a 28.1 tex(21 cotton count) yarn was made for using as fill yarn. The yarns were then two-plied to form a ply yarn.

The Nomex®/Kevlar®/Modacrylic/cotton yarn was used as the warp and Nomex®/Modacrylic yarn as the fill in a shuttle loom in a 3×1 twill construction. The greige twill fabric had a construction of 27 ends×17 picks per cm (68 ends×42 picks per inch), and basis weight of 244.1 g/m^2 (7.2oz/yd^2). The greige twill fabric prepared as described above was scoured in hot water and dried under low tension. The scoured fabric is then jet dyed using basic dye. The finished fabric 325.4 g/m^2 (9.6oz/yd^2) is then tested by its thermal and mechanical properties.

Example 4

A thermal protective and durable fabric was prepared having in the both warp and fill of ring spun yarns of intimate blends of Nomex® type 450, Kevlar® 29, Modacrylic and nylon. Nomex® type 450 is poly(m-phenylene isophthalamide)(MPD-I), Modacrylic is ACN/polyvinylidene chloride co-polymer with 15% antimony (known as Protex®M), Kevlar® 29 is poly(p-phenylene terephthalamide)(PPD-T) and the nylon used was polyhexamethylene adipamide.

A picker blend sliver of 25 wt. % of Nomex® type 450, 10 wt. % of Kevlar® 29, 60 wt. % of Modacrylic and 5 wt. % of nylon was prepared and processed by the conventional cotton system into a spun yarn having twist multiplier of 3.7 using a ring spinning frame. Two single yarns are then plied on the plying machine to make a two-ply yarn.

The Nomex®/Kevlar®/Modacrylic/nylon yarns were used as the warp and fill in a shuttle loom in a 3×1 twill construction. The greige twill fabric prepared as described above was scoured in hot water and dried under low tension. The scoured fabric is then jet dyed using basic dye. The finished fabric 295 g/m^2 (8.7 oz/yd^2) is then tested by its thermal and mechanical properties.

| | Example 1 | Example 2 | Example 3 | Example 4 |
|---|---|---|---|---|
| Basis Weight (opsy) | 9.0 | 8.7 | 9.6 | 8.7 |
| Thickness (mil) | 34 | 37 | 40 | 33.9 |
| Grab Test Break Strength (lbf) Warp/Fill D5034-95 | 215/158 | 189/163 | 205/164 | 160.2/132.3 |
| Trap Tear (lbf) Warp/Fill D5587-03 | 33/28 | 23/18 | 28/21 | 19/15 |
| Taber Abrasion (Cycles)CS-10/1000 g ASTM D3884-01 | 1578 | 1293 | 3143 | 974 |
| TPP (cal/cm2) NFPA 2112 | 15.2 | 15.3 | 16.3 | 13.5 |

-continued

| | Example 1 | Example 2 | Example 3 | Example 4 |
|---|---|---|---|---|
| Vertical Flame (inches) Warp/Fill ASTM D6413-99 | 3/3.2 | 3.1/3.6 | 2.9/3.0 | 3.1/3.6 |
| ARC Rating (cal/cm2) ASTM F1959-99 | 9.2 | 11.4 | 17.6 | 9.6 |

What is claimed is:

1. A yarn for use in arc and flame protection comprising:

(a) 40 to 70 weight percent modacrylic fiber, (b) 5 to 20 weight percent p-aramid fiber and (c) 10 to 40 weight percent m-aramid fiber, said percentages on the basis of components (a) (b) and (c).

2. The yarn of claim 1 comprising:

(a) 55 to 65 weight percent modacrylic fiber (b) 5 to 15 weight percent p-aramid fiber and (c) 20 to 35 weight percent m-aramid fiber.

3. The yarn of claim 1 which additionally contains (d) an abrasion resistant fiber, said percentages on the basis of components (a), (b), (c) and (d).

4. The yarn of claim 3 wherein the abrasion resistant fiber is present in an amount of 2 to 15 weight percent on the basis of components (a), (b), (c) and (d).

5. The yarn of claim 3 wherein the abrasion resistant fiber is nylon.

6. The yarn of claim 1 which additionally contains (e) an anti-static component, said percentages on the basis of components (a), (b), (c) and (e).

7. The yarn of claim 6 wherein the anti-static component is present in an amount of 1 to 5 weight percent of the total yarn.

8. The yarn of claim 6 wherein the anti-static component comprises carbon or metal fiber.

9. The yarn of claim 8 wherein the anti-static component comprises carbon.

10. A fabric suitable for use in arc and flame protection comprising:

a yarn the yarn further comprising (a) 40 to 70 weight percent modacrylic fiber, (b) 5 to 20 weight percent p-aramid fiber and, (c) 10 to 40 weight percent m-aramid fiber, said percentages on the basis of components (a) (b) and (c).

11. The fabric of claim 10 wherein the yarn comprises;

(a) 55 to 65 weight percent modacrylic fiber (b) 5 to 15 weight percent p-aramid fiber and (c) 20 to 35 weight percent m-aramid fiber.

12. The fabric of claim 10 which additionally comprises (d) an abrasion resistant fiber, said percentages on the basis of components (a), (b), (c) and (d).

13. The fabric of claim 12 wherein the abrasion resistant fiber is present in an amount of 2 to 15 weight percent on the basis of components (a), (b), (c) and (d).

14. The fabric of claim 12 wherein the abrasion resistant fiber is nylon.

15. The fabric of claim 10 which additionally contains (e) an anti-static component, said percentages on the basis of components (a), (b), (c) and (e).

16. The fabric of claim 10 which has a char length according to ASTM D-6413-99 of less than 6 inches.

17. The fabric of claim 10 which has arc resistance according to ASTM F-1959-99 of at least 0.8 calories per square centimeter per opsy.

18. The fabric of claim 17 wherein the arc resistance is at least 1.2 calories per square centimeter per opsy.

19. A garment suitable for use in arc and flame protection:

(a) 40 to 70 weight percent modacrylic fiber, (b) 5 to 20 weight percent p-aramid fiber and (c) 10 to 40 weight percent m-aramid fiber, said percentages on the basis of components (a) (b) and (c).

20. The garment of claim 19 comprising:

(a) 55 to 65 weight percent modacrylic fiber (b) 5 to 15 weight percent p-aramid fiber and (c) 20 to 35 weight percent m-aramid fiber.

21. The garment of claim 19 which additionally contains (d) an abrasion resistant fiber, said percentages on the basis of components (a), (b), (c) and (d).

22. The garment of claim 19 which additionally contains (e) an antistatic component, said percentages on the basis of components (a), (b), (c) and (e).

* * * * *